US012241636B2

(12) United States Patent
Johnson et al.

(10) Patent No.: US 12,241,636 B2
(45) Date of Patent: Mar. 4, 2025

(54) OVEN APPLIANCE HAVING A DUCT FOR IMPROVED HEATING

(71) Applicant: Haier US Appliance Solutions, Inc., Wilmington, DE (US)

(72) Inventors: Eric Scott Johnson, Louisville, KY (US); Rebekah Leigh Tyler, Louisville, KY (US); Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 223 days.

(21) Appl. No.: 17/224,458

(22) Filed: Apr. 7, 2021

(65) Prior Publication Data

US 2022/0325901 A1 Oct. 13, 2022

(51) Int. Cl.
*F24C 15/32* (2006.01)
*F24C 15/00* (2006.01)

(52) U.S. Cl.
CPC ..... *F24C 15/325* (2013.01); *F24C 15/007* (2013.01); *F24C 15/322* (2013.01)

(58) Field of Classification Search
CPC ..... F24C 15/32; F24C 15/007; F24C 15/36; F24C 15/12; F24C 15/2007; F24C 15/322; F24C 15/325; F27D 2009/0067; F27D 17/002; F27D 7/02
USPC ..... 126/21, 21 R
See application file for complete search history.

(56) References Cited

U.S. PATENT DOCUMENTS

| | | | | |
|---|---|---|---|---|
| 4,585,923 | A | 4/1986 | Binder | |
| 5,309,981 | A * | 5/1994 | Binder | F24C 15/025 219/400 |
| 7,102,105 | B2 | 9/2006 | Oh | |
| 9,516,704 | B2 | 12/2016 | Stanger | |
| 10,571,131 | B2 * | 2/2020 | Paller | F24C 15/322 |
| 2014/0013963 | A1 * | 1/2014 | Hoffmann | F24C 15/2007 99/403 |
| 2017/0292713 | A1 * | 10/2017 | Boedicker | F24C 15/006 |
| 2019/0003724 | A1 * | 1/2019 | Jeong | F24C 7/087 |
| 2019/0277511 | A1 * | 9/2019 | Flowers | F24C 15/2042 |
| 2020/0182484 | A1 * | 6/2020 | Cowan | F24C 15/2014 |

(Continued)

FOREIGN PATENT DOCUMENTS

| | | | |
|---|---|---|---|
| EP | 0067951 | A1 * | 5/1982 |
| EP | 2610557 | A1 | 7/2013 |

*Primary Examiner* — Allen R. B. Schult
*Assistant Examiner* — William C Weinert
(74) *Attorney, Agent, or Firm* — Dority & Manning, P.A.

(57) ABSTRACT

An oven appliance having a cabinet with a chamber positioned within the cabinet. The chamber is configured for receipt of a food item for cooking. The oven appliance also includes a door for providing selective access to the chamber and a plurality of walls including a top wall, a bottom wall, a back wall, a front wall, and opposing sidewalls defining the chamber. Further, the oven appliance includes a fan assembly operable to cause air to flow in the chamber and a fan cover arranged to at least partially cover the fan assembly. Moreover, the oven appliance includes a first heating element arranged adjacent to the bottom wall. In addition, the oven appliance includes a duct in fluid communication with the fan assembly and the first heating element for directing airflow in the chamber to the fan assembly and across the first heating element to heat the food item.

14 Claims, 5 Drawing Sheets

(56) References Cited

U.S. PATENT DOCUMENTS

| | | | | |
|---|---|---|---|---|
| 2022/0146099 | A1* | 5/2022 | Paller | F24C 15/32 |
| 2022/0282871 | A1* | 9/2022 | Garcia | F24C 15/322 |
| 2022/0346596 | A1* | 11/2022 | Neumayer | F24C 15/2042 |

* cited by examiner

OVEN APPLIANCE HAVING A DUCT FOR IMPROVED HEATING

FIELD OF THE INVENTION

The present disclosure relates generally to oven appliances and more particularly to oven appliances having a bottom duct in fluid communication with a fan assembly and a heating element so as to direct heated airflow to impinge on an underside of a food item during a cooking process.

BACKGROUND OF THE INVENTION

Oven appliances generally include a cabinet with a cooking chamber positioned therein. The cooking chamber is configured for receipt of food articles for cooking. The oven appliance also includes a heating element for generating heat energy for cooking. The heating element can be, e.g., an electric resistance element or a gas burner. Certain oven appliances also include features for forcing movement of heated air within the cooking chamber. Such oven appliances are generally referred to as convection ovens.

In typical conventional ovens, heated air within the cooking chamber can be circulated with a fan when in a convection mode. The fan initiates a flow of heated air through a plurality of slots in a top wall of the oven's cabinet. The heated air exiting the slots in the top wall generally flows in a vertical direction. Such a configuration distributes heat energy evenly to food articles cooking on a top rack within the cooking chamber. However, food articles cooking on a lower rack disposed below the top rack generally do not receive the benefits of the flow of heated air because the top rack or items disposed on the top racks prevent the flow of heated air from continuing to the lower rack. Thus, when cooking food items on both the top and lower racks the benefits of convection oven may be limited to the food items disposed on the top rack.

In certain other convection ovens, the fan initiates a flow of heated air through a plurality of slots in a sidewall or a back wall of the oven's cabinet. The heated air exiting the slots in the sidewall or back wall generally flows in a horizontal direction. Such a configuration may distribute heat energy more evenly to both the top rack and the lower rack disposed below the top rack compared to the configuration described above. However, heated air flowing from a back to a front of a food article may cause the back of the food article to cook more quickly than the front of the food article. Similarly, heated air impacting edges of a food article may cause the edges to cook more quickly than a center of the food article.

Furthermore, it can be desirable to provide alternative methods for cooking foods with less oil, but that provide a similar crispy texture similar to that of deep-frying. However, for traditional convection ovens with horizontal airflow, the food items must be flipped over and/or rotated during the cooking process to provide even cooking. Additionally, it can be difficult to achieve a crispy texture in an oven without over cooking the item.

Accordingly, an oven appliance having a bottom duct in fluid communication with a fan assembly and a heating element so as to direct airflow to impinge on an underside of a food item during a cooking process would be welcomed in the art.

BRIEF DESCRIPTION OF THE INVENTION

Aspects and advantages of the invention will be set forth in part in the following description, or may be obvious from the description, or may be learned through practice of the invention.

In one aspect, the present disclosure is directed to an oven appliance having a cabinet with a chamber positioned within the cabinet. The chamber is configured for receipt of a food item for cooking. The oven appliance also includes a door for providing selective access to the chamber and a plurality of walls including a top wall, a bottom wall, a back wall, a front wall, and opposing sidewalls defining the chamber. Further, the oven appliance includes a fan assembly operable to cause air to flow in the chamber and a fan cover arranged to at least partially cover the fan assembly. Moreover, the oven appliance includes a first heating element for heating the chamber and being arranged adjacent to the bottom wall. In addition, the oven appliance includes a duct in fluid communication with the fan assembly and the first heating element for directing airflow in the chamber to the fan assembly and across the first heating element to heat the food item.

In another aspect, the present disclosure is directed to a method for operating an oven appliance. The method includes placing one or more food items in a chamber positioned within a cabinet of the oven appliance. The method also includes heating the chamber via first and second heating elements arranged adjacent to a bottom wall and a top wall of the oven appliance, respectively. Further, the method includes providing a fan assembly adjacent to a back wall of the oven appliance. Moreover, the method includes operating the fan assembly of the oven appliance to direct airflow in the chamber across a top surface of the one or more food items adjacent to the second heating element to heat a top surface of the one or more food items and into a duct. Moreover, the duct is in fluid communication with the fan assembly and the first heating element so as to further draw the airflow across the first heating element and to heat a bottom surface of the one or more food items.

These and other features, aspects and advantages of the present invention will become better understood with reference to the following description and appended claims. The accompanying drawings, which are incorporated in and constitute a part of this specification, illustrate exemplary embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
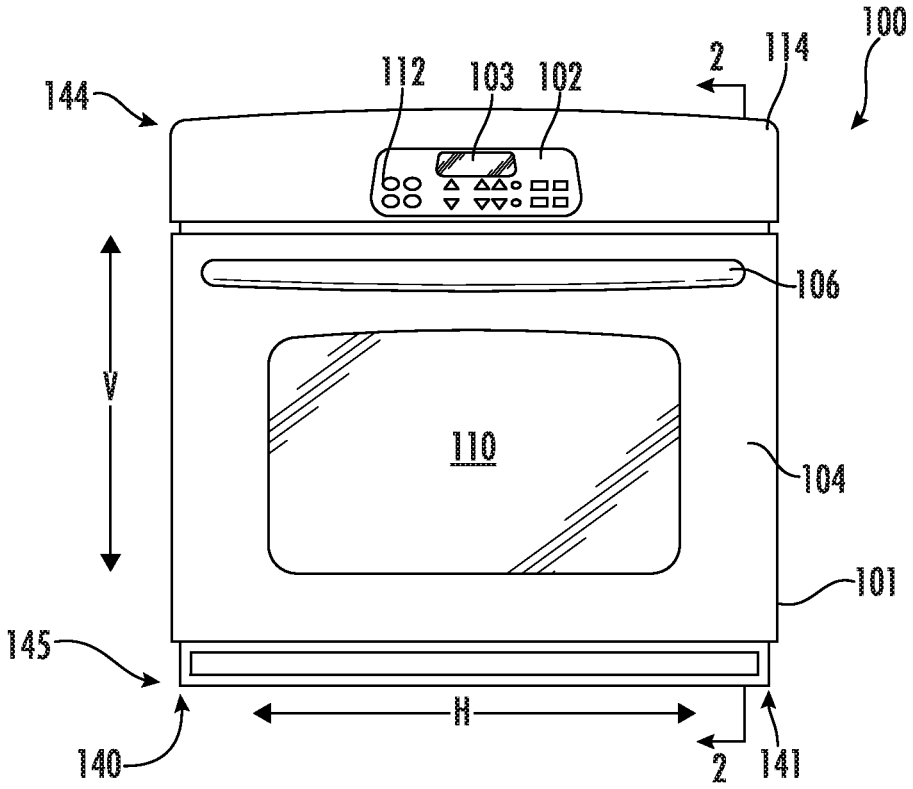
FIG. 1 provides a front view of an oven appliance according to an exemplary embodiment of the present invention.

Reference now will be made in detail to exemplary embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
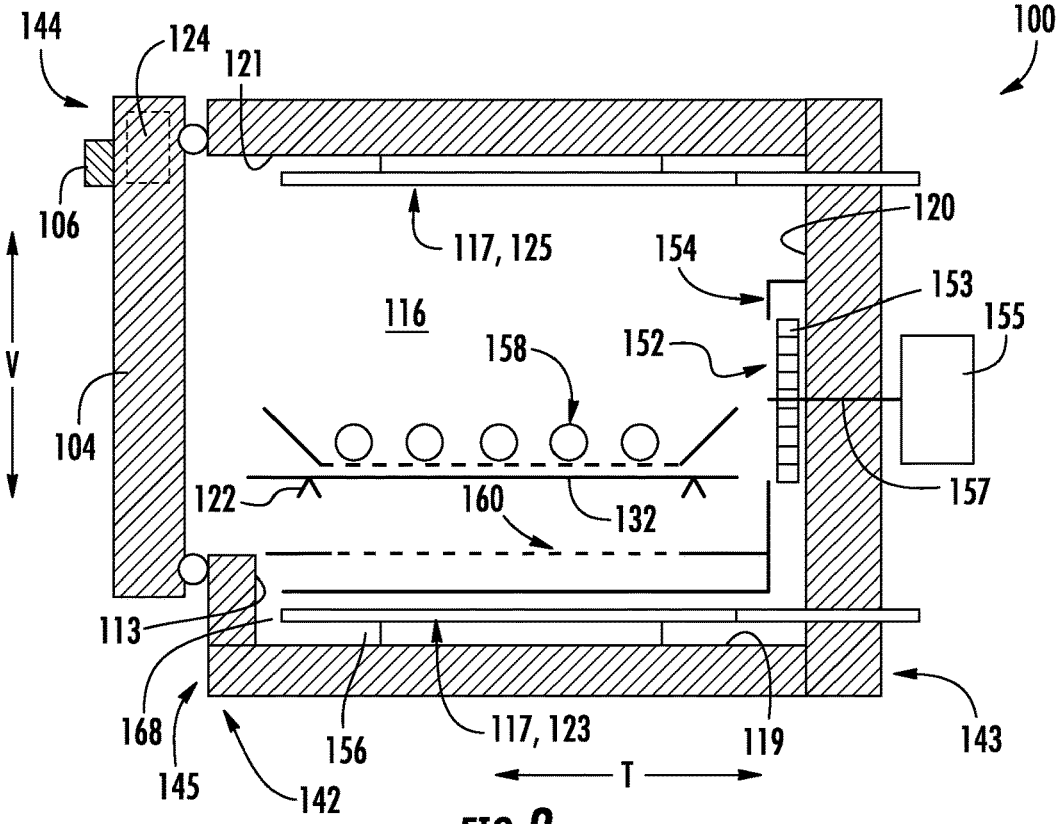
FIG. 2 provides a cross-sectional view of the oven appliance taken along the 2-2 axis of FIG. 1.
Figure 3:
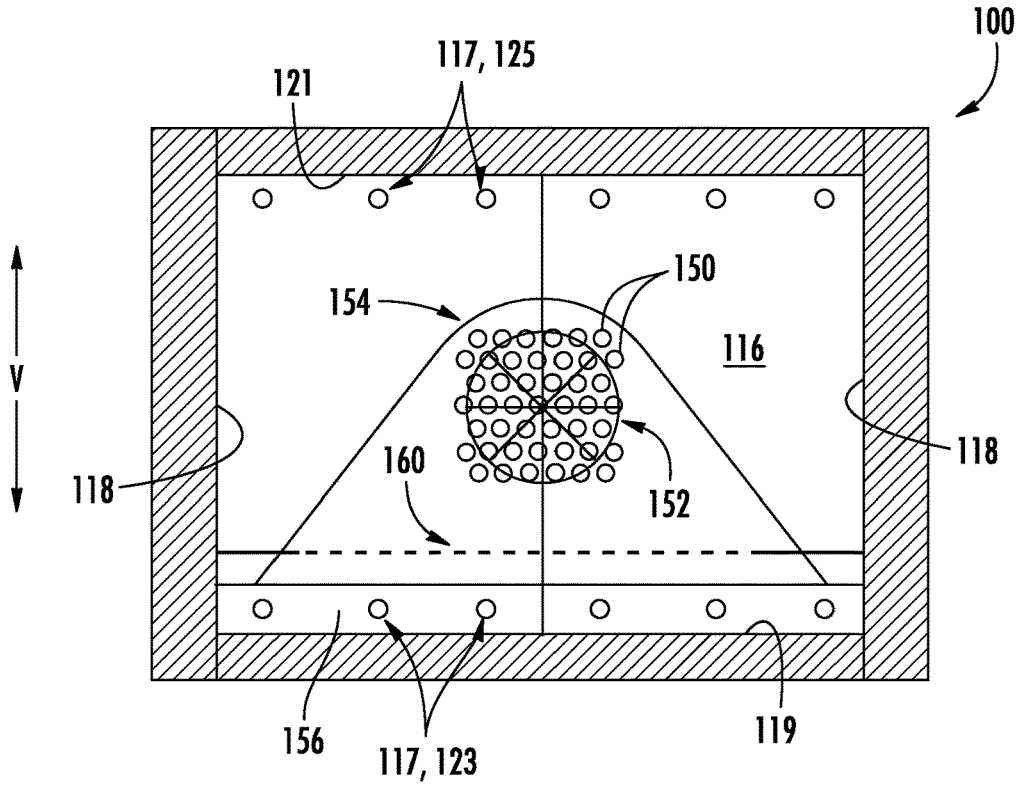
FIG. 3 provides a front, cross-sectional view of the oven appliance of FIG. 1.

Referring now to the drawings, FIGS. 1-3 illustrates an exemplary embodiment of an oven appliance 100 for providing improved heating is shown according to the present disclosure. In particular, FIG. 1 provides a front view of the oven appliance 100 according to the present disclosure. FIG. 2 provides a cross-sectional view of the oven appliance 100 taken along the 2-2 axis shown in FIG. 1. FIG. 3 provides a front cross-sectional view of the oven appliance 100 according to the present disclosure. As shown, the oven appliance 100 includes a cabinet 101 or housing with a cooking chamber 116 positioned therein.

The cabinet 101 extends between a first side 140 (FIG. 1) and a second side 141 (FIG. 1) along a horizontal direction H. Further, the cabinet 101 also extends between a front 142 (FIG. 2) and a back 143 (FIG. 2) along a transverse direction T. The cabinet 101 further extends between a top 144 and a bottom 145 along a vertical direction V. Transverse direction T is substantially perpendicular to horizontal and vertical directions H, V. Thus, vertical direction V, horizontal direction H, and transverse direction T are orthogonally oriented such that vertical direction V, horizontal direction H, and transverse direction T form an orthogonal directional system.

Moreover, as shown in FIGS. 2 and 3, the chamber 101 has interior walls including opposing sidewalls 118, front wall 113, bottom wall 119, back wall 120, and top wall 121 that define cooking chamber 116. Bottom wall 119 and top wall 121 are spaced apart along the vertical direction V, and sidewalls 118 extend along the vertical direction V between top wall 121 and bottom wall 119. Back wall 120 extends between sidewalls 118 along the horizontal direction and also extends between top wall 121 and bottom wall 119 along the vertical direction V.

In certain embodiments, the sidewalls 118 may include supports 122 (FIG. 2) for supporting one or more oven racks 132 (FIG. 2) that may be selectively positioned within chamber 116. Further, as shown in FIGS. 1 and 2, the oven appliance 100 may also include a door 104 with handle 106 that provides for opening and closing access to the chamber 116. As such, a user of the oven appliance 100 can place a variety of different items to be cooked in chamber 116 onto the oven racks 132. Heating elements 117 may be positioned at the top and the bottom of chamber 116 to provide heat for cooking and cleaning. More particularly, as shown, the heating elements 117 may include a first heating element 123 arranged adjacent to the bottom wall 119 and a second heating element 125 arranged adjacent to the top wall 121. Furthermore, as shown, one or more the heating elements 117 may include a heating element cover 160 arranged adjacent to a respective heating element 117. For example, as shown in the illustrated embodiment, the heating element cover 160 is positioned adjacent to the first heating element 123. Such heating element(s) 117 can be e.g., gas, electric, microwave, or a combination thereof. Other heating elements (not shown) could be located at other locations as well. A window 110 on door 104 allows the user to view e.g., food items during the cooking process.

Referring particularly to FIG. 1, the oven appliance 100 may further include a user interface panel 102 having a display 103 positioned on a top panel 114 with a variety of controls 112. In certain embodiments, the user interface panel 102 allows the user to select various options for the operation of the oven appliance 100 including e.g., temperature, time, and/or various cooking and cleaning cycles. Accordingly, operation of the oven appliance 100 can be regulated by a controller 124 (FIG. 2) that is operatively coupled i.e., in communication with, user interface panel 102, heating element(s), and other components of oven appliance 100 as will be further described.

By way of example, the controller 124 may include a memory and one or more processing devices such as microprocessors, CPUs, or the like, such as general or special purpose microprocessors operable to execute programming instructions or micro-control code associated with operation of the oven appliance 100. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 124 may be positioned in a variety of locations throughout the oven appliance 100. Thus, the controller 124 may be located under or next to the user interface panel 102 or otherwise within the top panel 114. In an exemplary embodiment, input/output ("I/O") signals are routed between the controller 124 and various operational components of the oven appliance 100 such as heating element(s) 117, controls 112, display 103, sensor(s), alarms, and/or other components as may be provided. In one exemplary embodiment, the user interface panel 102 may represent a general purpose I/O ("GPIO") device or functional block.

Although shown with touch type controls 112, it should be understood that the controls 112 and the configuration of the oven appliance 100 shown in FIG. 1 is provided by way of example only. More specifically, the user interface panel 102 may include various input components, such as one or more of a variety of electrical, mechanical, or electro-mechanical input devices including rotary dials, push buttons, and touch pads. Further, the user interface panel 102 may include other display components, such as a digital or analog display device designed to provide operational feedback to a user. The user interface panel 102 may be in communication with the controller 124 via one or more signal lines or shared communication busses. Also, the oven appliance 100 is shown as a wall oven but the present invention could also be used with other appliances such as e.g., a stand-alone oven, an oven with a stove-top, and other configurations as well.

In another embodiment, the oven appliance 100 may be equipped with features for selectively generating a forced flow of heated air within the cooking chamber 116 (e.g., using a fan(s) as discussed in greater detail below). Thus, the oven appliance 100 may generally be referred to as a convection oven. Such a flow of heated air can, e.g., decrease the required cooking temperature for food items, decrease the amount of time needed to cook food items, or assist in cooking food items more evenly.

Referring still to FIGS. 2 and 3, the oven appliance 100 may also include a fan cover 154 arranged adjacent to the back wall 120 to at least partially cover a fan assembly 152. Thus, as shown in the illustrated embodiment, the fan cover 154 may also include a plurality of vents or apertures 150 (also referred to herein as a first set of apertures 150) for receiving an airflow therethrough and across the fan assembly 152. For example, as shown, the fan assembly 152 may include a fan blade 153 and a fan motor 155 operably coupled to the fan blade 153 via a motor shaft 157. As such, the motor shaft 157 is configured to rotate the fan blade 153 about a fan axis. Further, as shown, the fan assembly 152 may be positioned adjacent to the back wall 120 of the oven appliance 100. In alternative embodiments, the fan assembly 152 may be located at any suitable location within the oven appliance and any suitable number of fan assemblies may be utilized.

Accordingly, the fan assembly 152 is operable to cause air to flow in the chamber 116. Moreover, the plurality of apertures 150 may have any suitable geometry and/or size. For example, as shown in FIG. 3, the plurality of apertures 150 may be circular. Alternatively, the plurality of apertures 150 may be elongated slots, triangular, oval, or any other suitable shape or combination of shapes.

In addition, as shown in FIGS. 2 and 3, the oven appliance 100 also includes a duct 156 in fluid communication with the fan assembly 152 and the first heating element 123 for directing airflow in the chamber 116 from the fan assembly 152 and across the first heating element 123 to cook a food item 158. For example, as particularly in FIGS. 4 and 5, the duct 156 may be formed, at least in part, via a boundary wall 166 extending generally perpendicular from the fan cover 154. In one embodiment, as shown, the boundary wall 166 of the duct 156 may be integral with the fan cover 154. In alternative embodiments, the duct 156 may be a separate component that is attached to the fan cover 154. In still another embodiment, the duct may abut against the fan cover 154 without being attached thereto.

Figure 4:
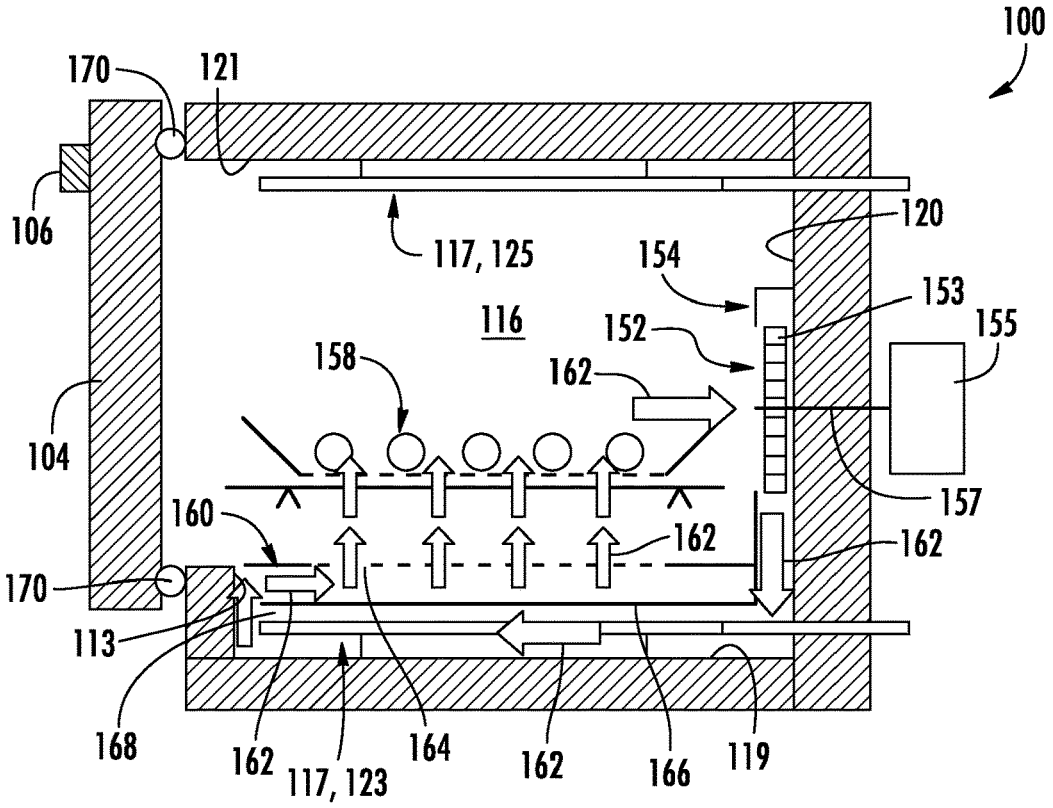
FIG. 4 provides a cross-sectional view of the oven appliance taken along the 2-2 axis of FIG. 1, particularly illustrating the direction of airflow flowing through the oven appliance.
Figure 5:
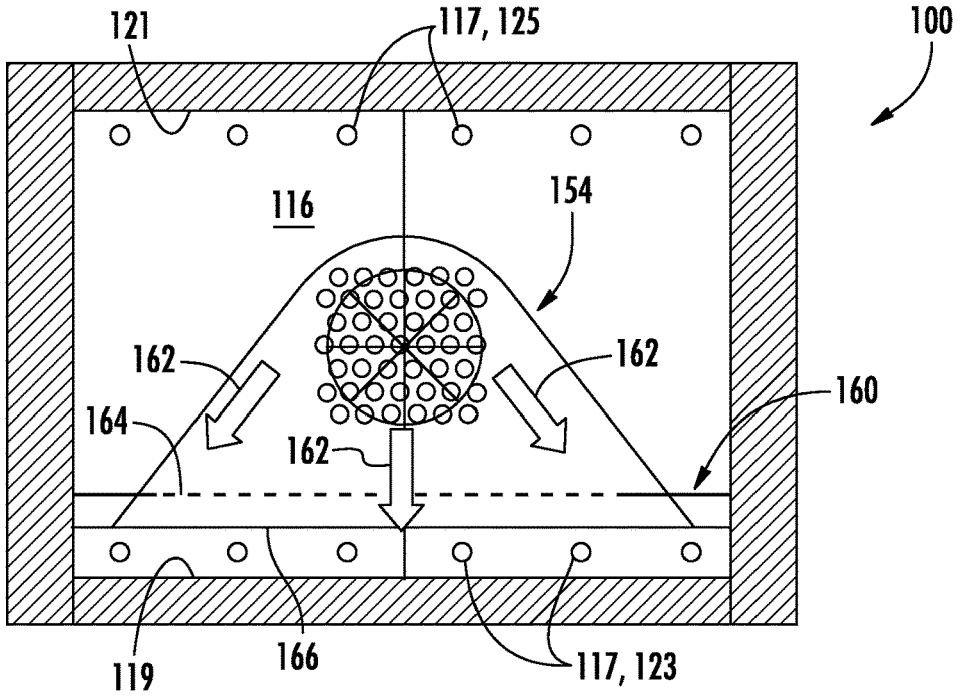
FIG. 5 provides a front, cross-sectional view of the oven appliance of FIG. 1, particularly illustrating the direction of airflow flowing through the oven appliance.

Accordingly, as shown in FIGS. 4 and 5, arrows 162 represent the airflow during a cooking process of the oven appliance. Thus, as shown, the duct 156 directs the airflow from the fan assembly 152 across the first heating element 123 and through the heating element cover 160 to heat the food item 158. In particular, as shown in FIG. 4, the heating element cover 160 may include a second set of apertures 164 that allows the airflow 162 to pass therethrough. Moreover, in certain embodiments, the heating element cover 160 may be removable, e.g., to assist with cleaning.

In further embodiments, as shown particularly in FIG. 4, the oven appliance 100 may also include an opening 168 between the boundary wall 166 and the front wall 113. Thus, in such embodiments, during operation of the oven appliance 100, the airflow 162 in the chamber 116 is drawn in through the first set of apertures 150 in the fan cover 154, down to and across the first heating element 123, up through the opening 168 between the boundary wall 166 and the front wall 113, and through the second set of apertures 164 of the heating element cover 160. Furthermore, as shown, the door 104 may be sealed shut, e.g., via one or more gaskets 170 or seals arranged between the door 104 and the front wall 113 of the oven appliance 100.

Figure 6:
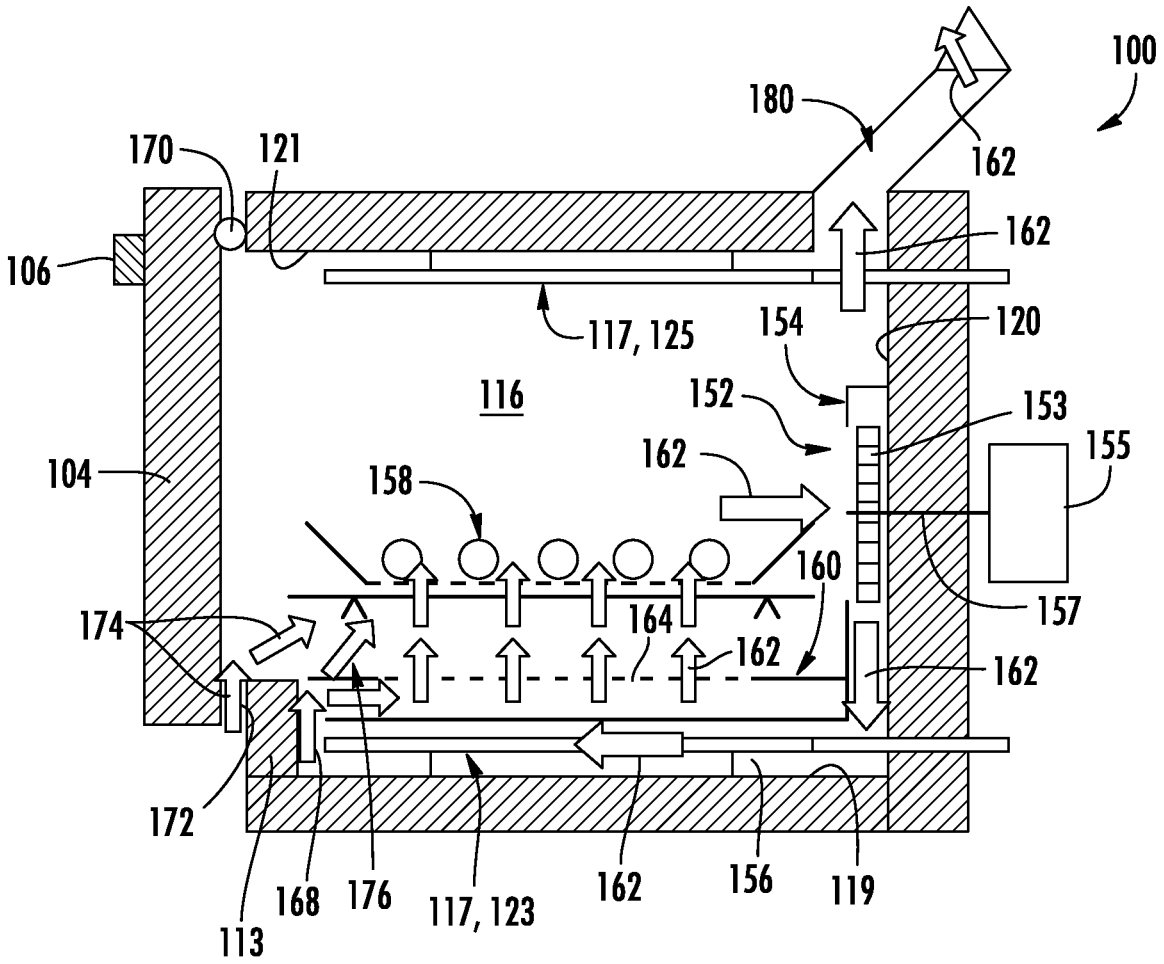
FIG. 6 provides a cross-sectional view of another embodiment of the oven appliance according to the present disclosure, particularly illustrating the direction of airflow flowing through the oven appliance.

In alternative embodiments, as shown in FIG. 6, the oven appliance 100 may include a gasket 170 to at least partially seal the door 104, but may also include a gap 172 between the door 104 and the front wall 113. In such embodiments, during operation of the oven appliance 100, ambient air 174 can be drawn through the gap 172 between the door 104 and the front wall 113 to dilute the airflow in the chamber 116. Furthermore, as shown, exhaust air 176 from the opening 168 between the boundary wall 166 and the front wall 113 may be used to entrain the ambient air 174 into the chamber 116. In addition, as shown, the oven appliance 100 may also include a vent 180. As such, during operation of the oven appliance 100, the airflow 162 in the chamber 116 can be further drawn out through the vent 180 of the oven appliance 100.

Figure 7:
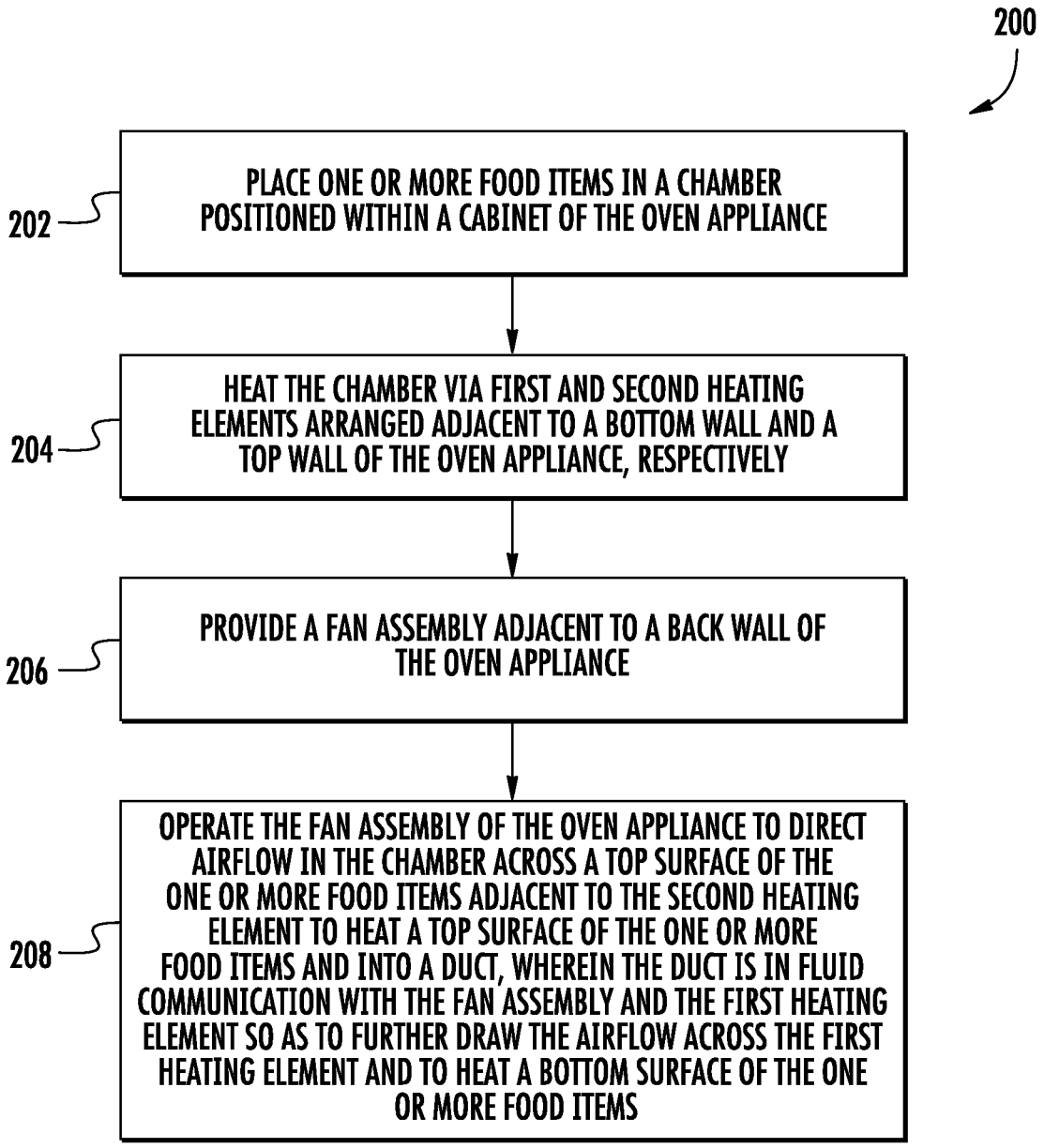
FIG. 7 provides a flow diagram of one embodiment of a method of operating an oven appliance according to the present disclosure.

Referring now to FIG. 7, a flow diagram of one embodiment of a method 200 for operating an oven appliance, such as oven appliance 100, is illustrated. In general, the method 200 will be described herein with reference to the oven appliance 100 described above with reference to FIGS. 1-6. However, it should be appreciated by those of ordinary skill in the art that the disclosed method 200 may generally be utilized to operate any other oven appliance having any suitable configuration. In addition, although FIG. 7 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown at (202), the method 200 includes placing one or more food items 158 in the chamber 116 positioned within the cabinet 101 of the oven appliance 100. As shown at (204), the method 200 includes heating the chamber 116 via first and second heating elements 123, 125 arranged adjacent to the bottom wall 119 and the top wall 121 of the oven appliance 100, respectively. As shown at (206), the method 200 includes providing the fan assembly 152 adjacent to the back wall 120 of the oven appliance 100. As shown at (208), the method 200 includes operating the fan assembly 152 of the oven appliance 100 to direct airflow 162 in the chamber 116 across a top surface of the food item(s) 158 adjacent to the second heating element 125 to heat the top surface of the food item(s) 158 and into the duct 156, wherein the duct 156 is in fluid communication with the fan assembly 152 and the first heating element 123 so as to further draw the airflow across the first heating element 123 to heat a bottom surface of the food item(s) 158.

More specifically, in an embodiment, the method 200 may include arranging the heating element cover 160 above the first heating element 123, wherein the duct 156 directs the airflow 162 from the fan assembly 152 across the first heating element 123 and through the heating element cover 160 to cook the bottom surface of the food item(s) 158.

Thus, in further embodiments, operating the fan assembly 152 of the oven appliance 100 to direct airflow 162 in the chamber 116 across a top surface of the food item(s) 158 and into the duct 156 in fluid communication with the fan assembly 152 and the first heating element 123 to draw the airflow across the first heating element 123 and to a bottom surface of the food item(s) 158 so as to heat and cook the top and bottom surfaces of the food item(s) 158 may include directing the airflow 162 in the chamber 116 through the first set of apertures 150 in the fan cover 154, down to and across the first heating element 123, up through the opening 168 between the boundary wall 166 and the front wall 113 of the oven appliance 100, and through a second set of apertures 164 of the heating element cover 160.

In additional embodiments, operating the fan assembly 152 of the oven appliance 100 to direct airflow 162 in the chamber 116 across a top surface of the food item(s) 158 and into the duct 156 in fluid communication with the fan assembly 152 and the first heating element 123 to draw the airflow across the first heating element 123 and to a bottom surface of the food item(s) 158 so as to heat and cook the top and bottom surfaces of the food item(s) 158 may include drawing ambient air 174 through the gap 172 between the door 104 of the oven appliance 100 and the front wall 113 to dilute the airflow 162 in the chamber 116 and/or drawing exhaust air 176 from the opening 168 between the boundary wall 166 and the front wall 113 to entrain the ambient air 174 into the chamber 116 and further drawing the airflow 162 in the chamber 116 out through the vent 180 of the oven appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet having a chamber positioned within the cabinet, the chamber configured for receipt of a food item for cooking;

a door for providing selective access to the chamber;

a plurality of walls comprising a top wall, a bottom wall, a back wall, a front wall, and opposing sidewalls defining the chamber;

a fan assembly comprising a fan blade operable to cause air to flow in the chamber;

a fan cover arranged to at least partially cover the fan assembly, the fan cover comprising a first set apertures through which the air from the chamber flows to the fan assembly across the fan blade, wherein the fan cover extends from the back wall and downward from the fan assembly to form a first airflow passageway between the fan cover and the back wall;

a first heating element for heating the chamber, the first heating element arranged adjacent to the bottom wall;

a heating element cover arranged above the first heating element, the heating element cover comprising a second set of apertures; and a boundary wall extending perpendicularly from the fan cover, the boundary wall being positioned above the bottom wall, the boundary wall defining a duct for directing the air, the boundary wall and the bottom wall together defining a second airflow passageway that receives the first heating element, the boundary wall and the front wall together defining a third airflow passageway, wherein the air from the chamber is directed into the fan assembly via the first set of apertures and downwards through the first airflow passageway, across the first heating element in the second airflow passageway, upwards through the third airflow passageway, back towards the back wall, and then into the chamber through the second set of apertures to heat the food item.

2. The oven appliance of claim 1, wherein, during operation of the oven appliance, the airflow in the chamber is drawn through the second set of apertures of the heating element cover.

3. The oven appliance of claim 2, further comprising a gap between the door and the front wall, wherein, during operation of the oven appliance, ambient air is drawn through the gap between the door and the front wall to dilute the airflow in the chamber.

4. The oven appliance of claim 3, wherein, during operation of the oven appliance, exhaust air from the opening between the boundary wall and the front wall is used to entrain the ambient air into the chamber.

5. The oven appliance of claim 4, further comprising a vent, wherein, during operation of the oven appliance, the air in the chamber is further drawn out through a vent of the oven appliance.

6. The oven appliance of claim 1, further comprising a gasket positioned between the door and the chamber and surrounding an opening of the chamber, wherein, during operation of the oven appliance, the door is sealed shut via the gasket.

7. The oven appliance of claim 1, wherein the boundary wall is integral with the fan cover.

8. The oven appliance of claim 1, wherein the boundary wall is a separate component secured to the fan cover or positioned adjacent to the fan cover.

9. The oven appliance of claim 1, wherein the fan assembly comprises a fan motor, the fan motor comprising, at least, a motor shaft operably coupled to the fan blade for rotating the fan blade about the motor shaft, and wherein the fan assembly is positioned adjacent to the back wall.

10. The oven appliance of claim 1, further comprising a second heating element arranged adjacent to the top wall.

11. The oven appliance of claim 1, wherein the heating element cover is removable.

12. A method for operating an oven appliance, the method comprising:

placing one or more food items in a chamber positioned within a cabinet of the oven appliance;

heating the chamber via first and second heating elements arranged adjacent to a bottom wall and a top wall of the oven appliance, respectively;

providing a fan assembly comprising a fan blade adjacent to a back wall of the oven appliance;

arranging a heating element cover above the first heating element, the heating element cover comprising a second set of apertures;

operating the fan assembly of the oven appliance to direct airflow in the chamber across a top surface of the one or more food items adjacent to the second heating element to heat a top surface of the one or more food items and into a first set of apertures of a fan cover arranged to at least partially cover the fan assembly, wherein the fan cover extends from the back wall and downward from the fan assembly to form a first airflow passageway between the fan cover and the back wall;

directing the airflow through the first airflow passageway and into a second airflow passageway defined by a boundary wall extending perpendicularly from the fan cover and a bottom wall of the oven appliance, the second airflow passageway defining a duct containing the first heating element, the airflow being directed across the first heating element; and directing the airflow upwards through a third airflow passageway defined by an end of the boundary wall and a front wall, back towards the back wall, and then into the chamber through the second set of apertures of the heating cover element to heat a bottom surface of the one or more food items.

13. The method of claim 12, further comprising:

drawing ambient air through a gap between a door of the oven appliance and the front wall to dilute the airflow in the chamber.

14. The method of claim 13, further comprising:

drawing exhaust air from the opening between the boundary wall and the front wall to entrain the ambient air into the chamber; and further drawing the airflow in the chamber out through a vent of the oven appliance.

* * * * *